US005975792A

United States Patent [19]

Goeken et al.

[11] Patent Number: 5,975,792

[45] Date of Patent: Nov. 2, 1999

[54] CITYLIFT

[76] Inventors: Klaus Goeken, Ringbahn Str. 8a, 10711 Berlin; John J. Pepe, Koenigsberger Str. 26, 12207 Berlin, both of Germany

[21] Appl. No.: 08/967,800

[22] Filed: Nov. 12, 1997

[51] Int. Cl.[6] ..... E02B 11/00; E05F 13/04; E01F 13/00; E01F 9/00

[52] U.S. Cl. ..... 404/6; 404/9; 49/131; 49/133

[58] Field of Search ..... 404/6, 9; 49/49, 49/131, 133

[56] References Cited

U.S. PATENT DOCUMENTS

| | | | |
|---|---|---|---|
| 4,003,161 | 1/1977 | Collins | 49/35 |
| 4,576,508 | 3/1986 | Dickinson | 49/131 |
| 4,577,991 | 3/1986 | Rolow | 404/6 |
| 4,666,331 | 5/1987 | Riley | 404/6 |
| 4,715,742 | 12/1987 | Dickinson | 404/6 |
| 4,858,382 | 8/1989 | Blair . | |
| 4,919,563 | 4/1990 | Stice . | |
| 5,054,237 | 10/1991 | Kapala et al. | 49/35 |
| 5,070,646 | 12/1991 | Colombo . | |
| 5,365,694 | 11/1994 | Macaluso . | |
| 5,462,384 | 10/1995 | Arlandias | 404/6 |
| 5,474,017 | 12/1995 | Mohebbi et al. | 116/209 |
| 5,476,338 | 12/1995 | Alberts | 404/6 |
| 5,560,733 | 10/1996 | Dickinson | 404/6 |
| 5,639,178 | 6/1997 | Wilson et al. | 404/6 |
| 5,819,471 | 10/1998 | Koerber | 49/49 |

FOREIGN PATENT DOCUMENTS

| | | |
|---|---|---|
| 29507399 | 4/1995 | Germany . |

*Primary Examiner*—Thomas B. Will
*Assistant Examiner*—Gary S. Hartmann
*Attorney, Agent, or Firm*—Ralph J. Mancini

[57] ABSTRACT

The present invention relates to an improved security control barrier for use in controlling ingress and egress to entranceways, exit ways, driveways, and parking spots. The device consists of a telescoping bollard inserted into a casing imbedded below ground and a locking mechanism for securing the telescoping bollard in the extended and retracted positions. The invention also serves as an effective anti-theft device.

14 Claims, 3 Drawing Sheets

CITYLIFT

BACKGROUND OF THE INVENTION

1. Field of the Invention

The present invention relates to an improved security control barrier for use in controlling ingress and egress to entranceways, exit ways, driveways, and parking spots. The device consists of a telescoping bollard inserted into a casing imbedded below ground and a locking mechanism for securing the telescoping bollard in the extended and retracted positions. The invention also serves as an effective anti-theft device.

2. Description of the Related Art

Various devices employed to control access to parking spaces and ingress/egress to entranceways have been proposed. Often found are retractable or articulating devices which consists of a post or barrier frame that is pivotally connected to a fixed base. The post or barrier frame is then raised from a near horizontal position when retracted, to a vertical position when employed. U.S. Pat. No. 4,858,328 issued to Ellgass is one such device. A disadvantage of such devices is that they are exposed above ground making them subject to vandalism and excessive damage from vehicles transgressing over them, and therefore require frequent repair or replacement.

Other prior art include systems which employ bollards encased below the surface. U.S. Pat. No. 4,919,563 issued to Stice and U.S. Pat. No. 5,476,338 issued to Alberts are exemplary of this art. The Stice and Alberts devices are relatively complicated employing a worm gear/screw lift mechanisms and are dependent upon underground motors and external power sources (Electrical Current or Battery) for their operation. Underground environmental exposure to subterranean electronic devices is undesirable. Both devices contain a large number of parts and components. Maintenance for these type of devices is rather extensive.

Prior art such as U.S. Pat. No. 4,003,161 issued to Collins is designed as a retractable barrier without a lift assistance mechanism and is employed using human power. As a result devices of this art are disadvantaged by being of lighter less sturdy construction so as to enable a human to raise the device solely with manual power.

U.S. Pat. No. 4,576,508 issued to Dickenson is described as an anti-terror barricade capable of stopping the movement of vehicles. This art employs a below the surface bollard raised by a hydraulic lift mechanism. The hydraulic lift mechanism is activated through an electrical control system. Again, underground environmental exposure to a subterranean electronic device and subterranean hydraulic system is undesirable. Maintenance for hydraulic systems is extensive. Operation based upon two dependent power sources (electrical power and hydraulic power) degrades reliability. U.S. Pat. No. 4,715,742 issued to Dickinson is also an anti-terror barricade intended to stop the movement of vehicles. This below the surface bollard is raised by the stored energy of a metal coil spring. The coil spring is released and locked through an electronically or manually engaged bolt. The bolt and the control box which houses the bolt are recessed just below grade level. Access to the control is through a locked cover. Both the bolt and the cover to the control box are located too close to the surface and could result in sabotage or vandalism to the device. Both of these Dickinson systems are anti-terror devices and as such are intended to withstand severe impacts. As a result, the increased costs of creating this capability make widespread use of the devices as general vehicle parking or passageway security barriers impracticable.

Further art also include telescoping posts which are raised exclusively through the stored energy of pneumatic or hydraulic springs. These devices are affected often by temperature variations. They are disadvantaged, in that in extremely cold temperatures the stored energy of the spring is severely degraded to the point where effective operation of the device through the exclusive power of the spring may not be feasible or to the point where an extremely powerful spring is required to operate in cold temperatures. Such a powerful spring would require extreme manual pressure to retract the device making the retraction very difficult.

An object of the present invention is to provide a gas spring lift assisted telescoping security bollard that is functional within a wide temperature range, a telescoping bollard which displays great strength and stability, and one that is easy to operate and install. Accordingly, there is also a need for such a device that has few parts and is easy to repair.

Another object of the bollard is to provide an anti-theft device which is extremely sturdy, stable, and one which would require a very long time to defeat thus resulting in a prolonged exposure of someone committing a criminal act.

A further intent of the present art is to provide a stable security bollard that is easily installed, and easy to maintain and reliable in its employment.

A further object of the present invention is to provide a security bollard that is of simple design, has few parts and components, and one that is economically priced.

Still a further object of this invention is to provide a telescoping bollard that guarantees proper drainage and one that will not have its operation be adversely affected by dirt and debris or extreme climatic conditions.

Still a further object of the present invention is to present a telescoping bollard that is locked in both the extended and retracted positions.

These and other objects are satisfied by the device of the present invention.

SUMMARY OF THE INVENTION

The present invention generally relates to a security barrier device for preventing ingress and egress in public thoroughfares, comprising a foundation casing member, the casing member adapted to be installed below grade; a bollard member telescopically positioned in relation to the casing member, the bollard member being retractable and extendible with respect to the casing member; and a spring member affixed between the casing member and the bollard member, the spring member adapted to provide lift assistance between the casing member and the bollard member; wherein the stored energy of the spring member is at equilibrium with the weight of the bollard member, such that retraction and extension of the bollard member with respect to the casing member is independent of temperature variations.

DETAILED DESCRIPTION OF THE DRAWINGS

FIG. 1 is an enlarged side view of the device illustrating extended and retracted positions.

FIG. 2 a top plan view of the control head and box-like container

DETAILED DESCRIPTION OF THE INVENTION

Figure 1:
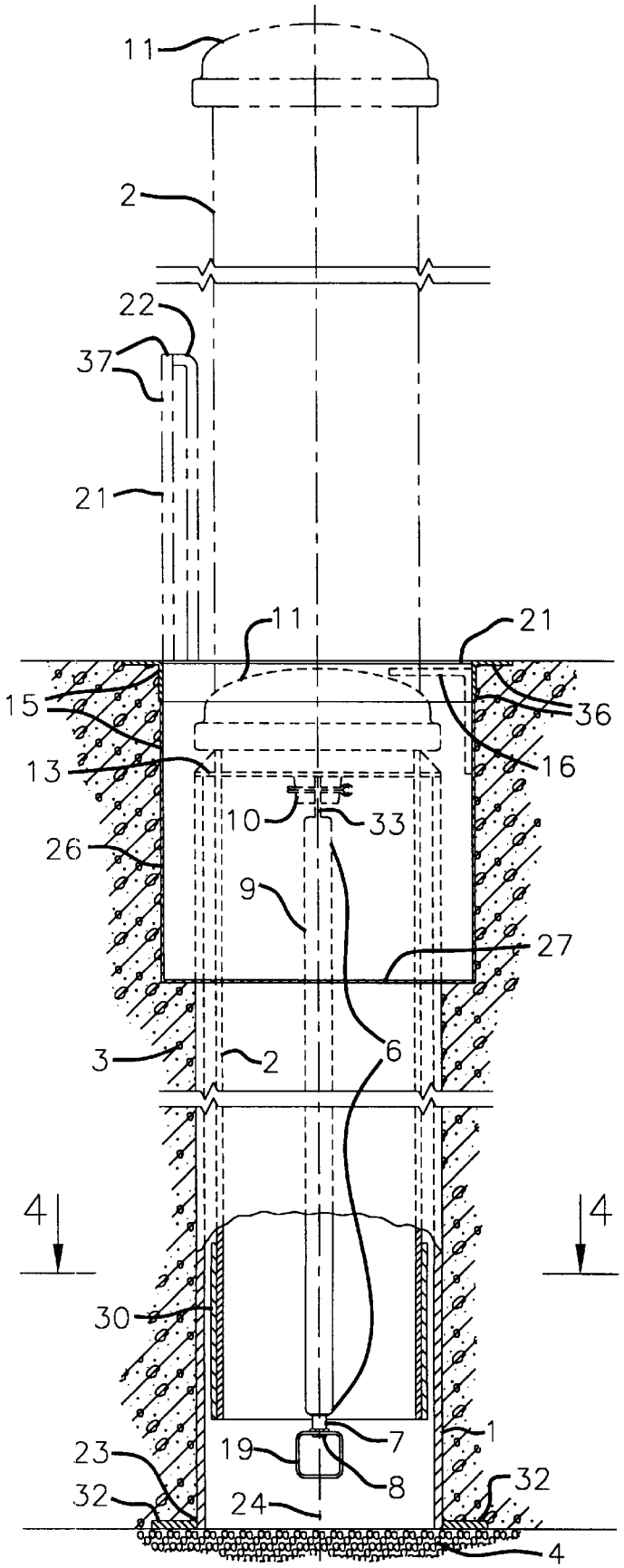

As will be understood in the following discussion the present invention is generally directed to a manually operated, gas spring lift assisted bollard that is unique in its design. The present invention incorporates the simplistic designs found in manually operated systems yet is capable of a lifting an exceptionally sturdy, heavier bollard.

The bollard of the present invention is designed so that the stored energy of the gas spring and the weight of the telescoping bollard are at equilibrium at a specific temperature range of C.−20–+40, whereby in warmer temperatures the telescoping bollard will rise solely through the stored energy of the gas spring and is retracted with minimal human power. In extremely cold temperatures the addition of minimal human power to raise the telescoping bollard offsets the slightly reduced efficiency of the gas spring in colder temperatures. A hand grip located in the control head of the telescoping bollard is employed to manually assist in raising and lowering the telescoping bollard. Through this adaptation of the combined stored energy of the gas spring and human power; it can be ensured that a stable and heavy telescoping bollard, that is easily extracted and retracted, can be functional with use of a gas spring in all temperature ranges.

On the other hand, a heavy and stable telescoping bollard which is raised exclusively through the stored energy of a gas spring in extremely cold temperatures must exert extreme pressure for it to overcome ice an frozen dirt which could impede extraction of the telescoping bollard. As a result of the extreme pressure of the gas spring to extend the telescoping bollard it will require an equal amount of human power to retract the telescoping bollard thus making it unnecessarily difficult or impractical.

A feature of this device is that when retracted it is completely embedded below the surface. The control head of the device is located subsurface in a steel quadrangular box-like container. The container has a double metal cover which is flush with the surface when closed. The closed cover can support the weight of a traversing vehicle. The metal cover is affixed to the box-like container so that it pivots. When the cover is opened to a full vertical position which is perpendicular with the surface it can be depressed to a retracted subsurface position. The container has a metal bottom which is welded to the foundation bollard.

Listed below are further features if this art. Located on the outer rim of the foundation bollard at grade level is a collar employed to prohibit larger particles of dirt and debris from falling between the telescoping and foundation casing. Fine particles of dirt and debris will fall between the telescoping bollard and the foundation casing and are deposited harmlessly on a crushed rock foundation. It is also possible to rinse the dirt away.

The bottom of the foundation casing is open excluding a single connecting brace transversing the diameter of the foundation casing. The telescoping bollard is also open at the lower end. This open end construction allows fine particles of dirt and debris to fall or be rinsed away and allows for easy subterranean drainage. The connecting brace transversing the bottom of the foundation casing is employed to seat the lower end of the gas spring piston rod. Affixed upon the connecting brace is a threaded socket. This socket allows for the easy, yet secure fastening of the gas spring piston rod to the foundation casing. The device is set upon a foundation of crushed rock which ensures proper drainage and it is also embedded in concrete.

The locking mechanism for the placement of the telescoping bollard in both the extended and retracted positions is through a rotating activation s-flange affixed in a corner of the quadrangular box-like container. A key activated spring lock controls movement of the rotating s-flange. The spring lock prohibits rotation of the s-flange and thus unauthorized extension or retraction of the telescoping bollard. Affixed to the lower end of the springlock at a right angle is said s-flange. The s-flange extends horizontally and when rotated to a locked position rests atop the control head of the telescoping bollard prohibiting upward movement. When the telescoping bollard is fully extended the s-flange is rotated and extends horizontally into a receiving slot located in the lower end of the telescoping bollard. When the flange is rotated into the receiving slot upward or downward movement of the telescoping bollard is prohibited. When rotated to an open position the s-flange does not prohibit upward or downward movement of the telescoping bollard.

As illustrated in FIG. 1 the security barrier is comprised of a tubular foundation casing 1 permanently installed below the grade, and a telescoping bollard 2 which is telescopically extended out of the foundation casing 1. The telescoping bollard has a retracted, non-obstructing position and an extended obstructing position. The foundation casing 1 has a central axis extending longitudinally 24 which is co-alligned with the central axis of the telescoping bollard 2. The foundation casing 1 is made of tubular steel and has a diameter of approximately 165 mm. The telescoping bollard 2 is also made of tubular steel and has a diameter of 150 mm whereas the diameter is to ensure sufficient weight and stability. The foundation casing 1 is anchored in a conical concrete foundation 3 and is seated upon a bed of gravel 4 which ensures effective subterranean drainage of surface waters.

Figure 4:
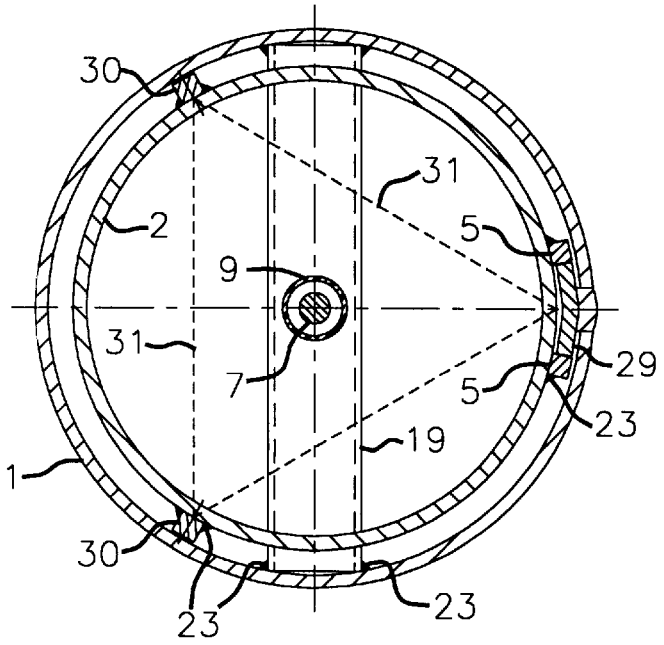
FIG. 4 is a plan sectional view of taken along lines b—b of FIG. 1.

As illustrated in FIG. 4 the telescoping bollard 2 has running on its exterior vertical length from starting from the bottom up to approximately ⅓ its full length, two circumferentially located guide-rails 5. The two circumferentially located guide-rails 5 receive between them a metal guide strip 29 running vertical and welded to the inner wall of the foundation casing 1. The guides-rails 5 and the metal guide strip 29 prohibit rotation of the telescoping bollard 2 on its vertical axis. Also located on the exterior walls of the telescoping bollard 2, along the intersects of hypothetical equilateral triangle 31 which has one corner centered on guide strip 29, and running ⅓ its vertical length from the bottom up are two additional metal bushings 30. Metal bushings 30 ensure proper space is maintained between the telescoping bollard 2 and the foundation casing 1 so that fine particles of dirt an debris can fall and surface water can properly drain on to the crushed rock foundation 4.

Figure 2:
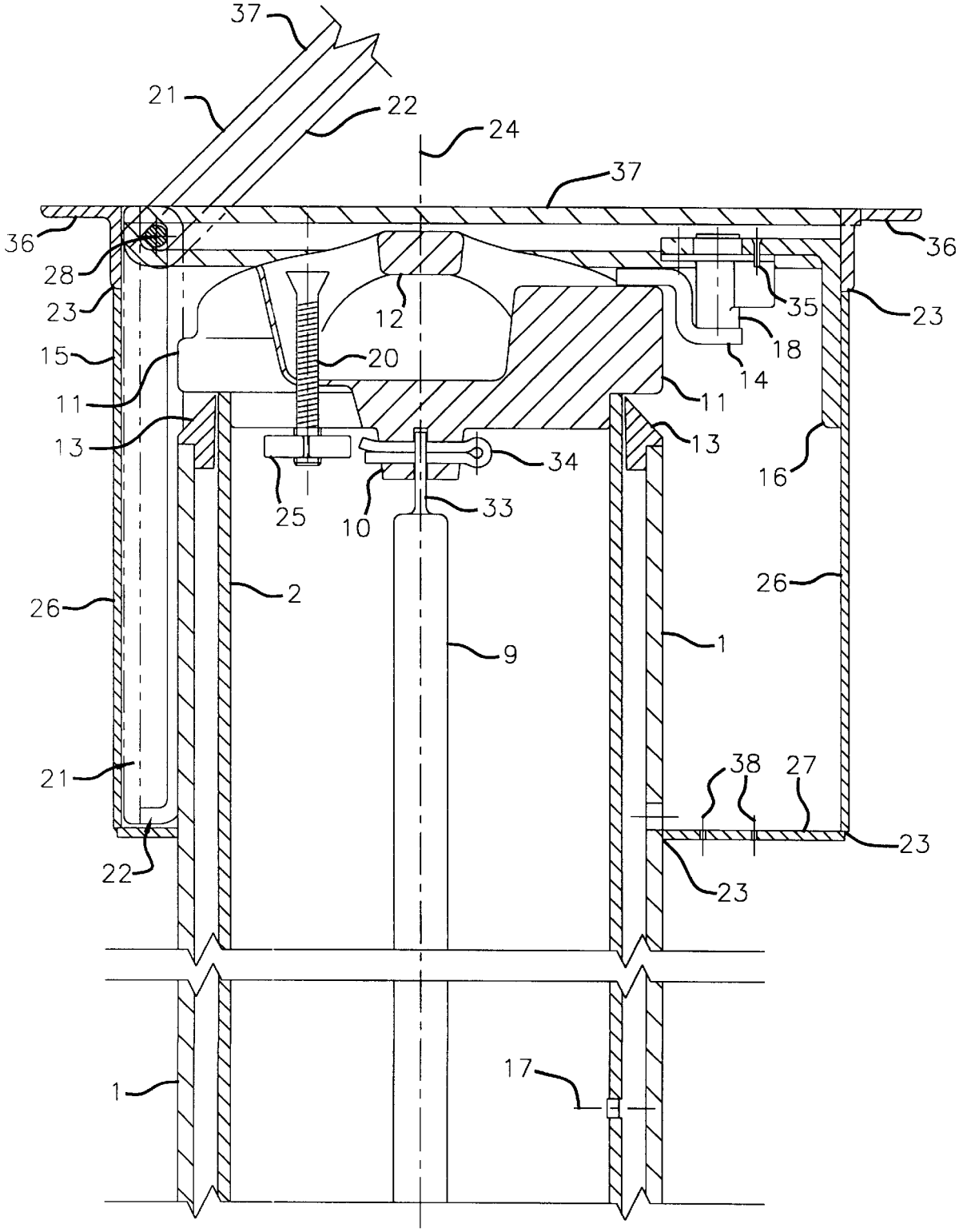

As also illustrated in FIGS. 1, 2 and 4, located between the telescoping bollard 2 and the foundation casing 1 along the vertical axis 24 is a gas spring 6 lift mechanism. The telescoping bollard 2 is assisted in movement from the retracted position to the extended position via gas spring 6. The gas spring is comprised of a compression cylinder 9, which has a flanged eyelet 33 welded to its upper end, and a piston rod 7 which extends from its lower end. The lower end of the gas spring piston rod 7 is externally threaded and screwed into the internal threads of socket 8. The threaded socket 8 is centered upon a quadrilateral connecting brace 19 transversing the diameter of the bottom of the foundation casing 1 and is welded in place. The quadrilateral connecting brace 19 is welded to the lower inner walls of the foundation casing 1. The compression cylinder 9 of the gas spring 6 is affixed to the upper end of the telescoping bollard 2 with a cotter pin 34 or similar device through its flanged eyelet 33 to a clevis 10 located and molded in the underside of the telescoping bollard control head 11.

As illustrated in FIGS. 1 and 2 fastened to the top of telescoping bollard 2 is a control head 11 which is affixed to the telescoping bollard 2 with two diametrically opposite sunken screws 20 or the like. The screws 20 are screwed into diametrically opposite metal sockets 25 welded on the upper inner wall of the telescoping bollard 2 and flush with its upper end. The control head 11 contains by design an integrated hand grip 12. On the upper end of the foundation bollard 1 is a steel collar 13 affixed to prohibit large particles of dirt and debris from falling between the foundation casing 1 and the telescoping bollard 2. and also serves as a mechanism to prohibit total extension of the telescoping bollard 2 out of the foundation casing 1.

As illustrated in FIGS. 1, 2, and, 3 a feature of the device in this embodiment is that when in the retracted position it is completely embedded below the surface in a box-like container 15. The box like container is comprised of a metal cover 37 which is housed in box-like cover metal frame 36. Box-like container frame 36 is in the form of an L shaped angle iron which has one flange horizontal with the ground surface and one flange vertical and welded to the four metal box-like container walls 26. Welded to the four metal box-like container walls 26 is the box-like container metal bottom 27. Dependent upon the geographic location of emplacement of the device box-like container metal bottom 27 can have drainage outlets 38.

Figure 3:
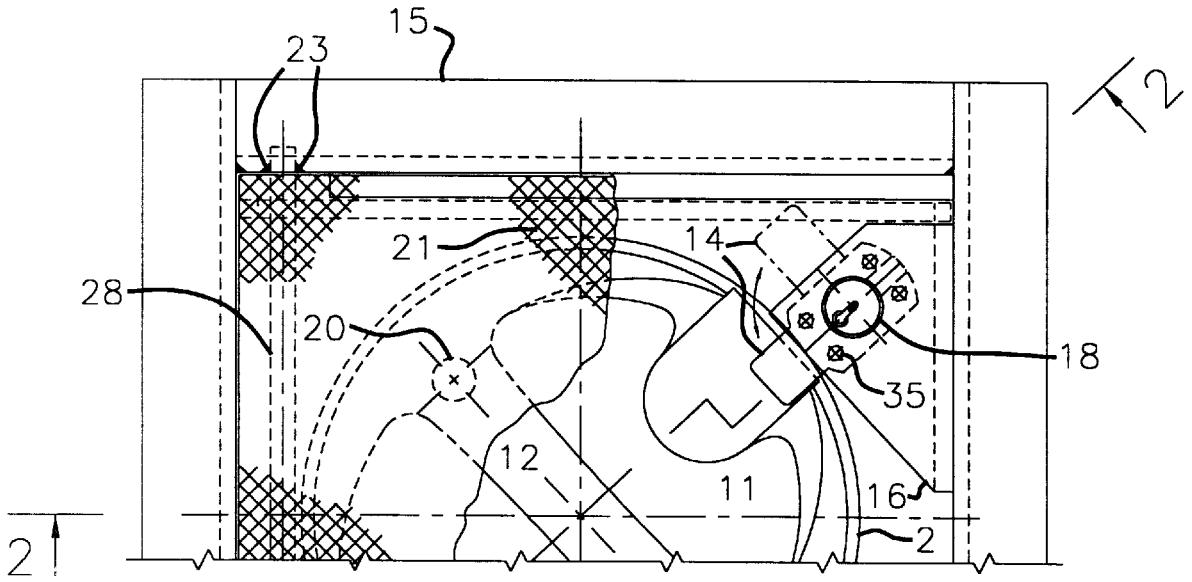
FIG. 3 is side a sectional view of the device and box-like container.

As further illustrated in FIGS. 1, 2, and 3 the box-like container 15 has an articulating quadrilateral metal cover 37 that is flush with the ground when in a closed horizontal position. The metal cover 37 is comprised of an upper quadrilateral plate 21 and a lower quadrilateral plate 22. Lower quadrilateral plate 22 is rounded at its pivotal and opposite latitudinal sides and welded to upper quadrilateral plate 21. As illustrated best in FIGS. 1 and 2 metal cover 37 is substantially hollow for pivotal movement between a first closed horizontal position which is flush with the surface, a second vertical raised position that is perpendicular with the surface to a third retracted position that is subsurface. A round metal dowel 28 is positioned latitudinal through hollow metal cover 37 and journaled through walls 26 of box like container 15. The ends of metal dowel 29 which protrude externally through walls 26 of box-like container 15 are welded in place to the exterior walls 26. Metal dowel 28 serves as the pivot point for longitudinal articulation of metal cover 37.

As illustrated in FIGS. 2 and 3, to lock the telescoping bollard 2 in place there is a rotating s-flange 14 located in an upper corner of the quadrangular box-like container 15. The s-flange 14 is affixed to the bottom of a key activated lock 18. Lock 18 and connecting s-flange 14 prohibit unauthorized extension or retraction of the telescoping bollard 2. Lock 18 is inserted on its vertical axis in a formed receptacle in angle iron 16. Angle iron 16 is welded to the inner wall 26 of quadrangular box-like container 15. Lock 18 can also be replaced to receive other control devices/locking mechanisms unique to individual countries. Located in the lower exterior wall of the telescoping bollard 2 is a receiving slot 17. The receiving slot 17 extends through the wall of the telescoping bollard 2. The receiving slot 17 functions in conjunction with s-flange 14 when in the fully extended position. Receiving slot 17 is in symmetry with the position of s-flange 14 at the fully extended position of the telescoping bollard 2. When s-flange 14 is rotated to a locked position resting inside receiving slot 17, as illustrated in FIG. 3, the telescoping bollard 2 cannot be extended or retracted. When s-flange 14 is rotated to a locked position resting atop control head 11 in the retracted position as illustrated in FIG. 2 the telescoping bollard 2 cannot be extended or retracted. When s-flange 14 is rotated to an open position the telescoping bollard 2 can be extended or retracted.

In order to guarantee successful operation of the gas spring, and therefore the bollard, in all temperature ranges. operation of the bollard is designed to be used with the assistance of human power. This means that the stored energy of the gas spring is in equilibrium with the weight of the telescoping bollard 2 to ensure that in warmer temperatures the bollard is extended/retracted with the minimal assistance of human power and in colder temperatures a slightly greater human force is required to extend/retract the bollard by use of the hand grip. As an example, the stored energy of the gas spring is 180N at +20 C with the balanced weight of 21 kg for the telescoping bollard 2. whereas in this instance at −20 C the telescoping bollard must be extracted with human power of 2 KP and at +10 C the telescoping bollard 2 is extended with less force. Gas Spring Model 10-22 produced by the firm Bansbach is suitable for this device.

The foundation bollard 1 is open at the bottom, excluding the connecting brace 19, to allow for drainage from moisture and or fine particles of dirt and debris. The telescoping bollard is also open at the lower end. Welded collar 13 located at the upper end of the foundation casing 1 prohibits large particles of dirt and debris from falling between the foundation bollard 1 and the telescoping bollard. Also welded to the bottom of the external wall of the foundation casing 1 at a right angle is a annular metal support 32. This support provides stability during the installation process.

Another preferred embodiment of this device is without the box-like container 15. In this embodiment control head 11 is located slightly above the surface when in the retracted position and a similar key locking mechanism is employed.

It will be understood by those skilled in the art that various modifications and changes can be made to the various embodiments disclosed herein without departing from the spirit and scope of the invention. For example, the bollard may telescope over the casing, the locking mechanism can be made to be automatic, various lift assist mechanisms may be used within the weight equilibrium parameters, etc., therefore, the above description should not be construed as limiting, but merely as exemplary embodiments. Those skilled in the art will envision other modifications within the spirit and scope of the invention as defined by the claims set forth hereinbelow.

What is claimed:

1. A security barrier device for preventing ingress and egress in public thoroughfares, comprising:

a foundation casing member which is open on its bottom surface, the casing member adapted to be installed below grade, a bollard member having outer and inner walls and a control head, said bollard member telescopically positioned in relation to the casing member, the bollard member being retractable and extendible with respect to the casing member, and a gas spring member affixed between the casing member and the bollard member, the gas spring member capable of storing energy and adapted to provide lift assistance between the casing member and the bollard member;

wherein the stored energy of the gas spring member is at equilibrium with the weight of the bollard member, such that retraction and extension of the bollard member with respect to the casing member is independent of temperature variations.

2. The device of claim 1, further comprising a brace member positioned internal to the casing member and the bollard member, the spring member being affixed between the bollard member and the brace member.

3. The device of claim 1, which has guide rails and bushings located on the outer walls of the telescoping bollard.

4. The device of claim 2, further comprising a locking mechanism, the locking mechanism being adjustable to restrict movement of the bollard member with respect to the casing member when the bollard member is fully retracted and when the bollard member is fully extended.

5. The device of claim 3, wherein the locking mechanism includes a rotatable s-flange member which engages the control head or receiving slot to prevent telescopic movement of the bollard with respect to the casing member.

6. The device of claim 1, wherein the stored energy of the spring member and the weight of the bollard member are at equilibrium such that at temperatures of more than 10° C., the bollard member is extendible by release of the stored energy of the spring member 6 and at lower temperatures the bollard member is extendible through the combined force of the stored energy of the spring and manual intervention.

7. The device of claim 5, wherein the bollard member has a weight of about 19–23 kg and the stored energy of the spring member is so balanced with the weight of the bollard member such that at temperatures lower than −20° C., intervening manual force in the amount of about 1.3 kp is required to extend the bollard member.

8. The device of claim 1, wherein the casing member includes a collar member positioned at the top end of the casing member to preclude dirt and debris from falling between the casing member and the bollard member.

9. The security bollard of claim 8 wherein the stored energy of the gas spring and weight of the telescoping bollard are at equilibrium such that at temperatures of more than about 10° C., the telescoping bollard is extendible by release of the stored energy of the gas spring and at lower temperatures the telescoping bollard is extendible by release of the stored energy of the gas spring and human power.

10. The device of claim 8, wherein the bollard member has a weight of about 19–23 kg and the stored energy of the spring member is so balanced with the weight of the bollard member such that at temperatures lower than 20° C., intervening manual force in the amount of about 2 kp is required to extend the bollard member.

11. The device of claim 8, wherein the bollard member is located below ground level in a metal box-like container which has a metal cover that is substantially hollow for pivotal movement between a first closed horizontal position which is flush with ground level, a second vertical raised position that is perpendicular with the surface to a third retracted position that is subsurface.

12. The security bollard of claim 1 wherein at the upper end, inside of container (15) is a locking mechanism (18) S-flange (14) is affixed to lock (18) to lock the telescoping bollard (2) in either the extended or retracted positions.

13. The security bollard according to claim 12 wherein the s-flange (17) can be locked by lock (18) which is located in the box-like container (15) thus providing a means to lock the telescoping bollard (2) in both the extended and retracted positions.

14. A security bollard for entrance ways and parking spots which comprises a tubular steel foundation casing permanently installed below the grade and a tubular steel telescoping bollard having a control head which retracts and extends from within the foundation casing, wherein the security bollard is so configured that affixed between the foundation casing and the telescoping bollard is a self contained gas spring capable of storing energy, said spring employed to provide lift assistance, said control head of said bollard having a hand-grip, the bollard being constructed such that the stored energy of the gas spring is at equilibrium with the weight of the telescoping bollard such that at temperatures of less than about 10° C., the telescoping bollard is extendible by release of the stored energy of the gas spring and human power.

* * * * *